United States Patent [19]

Da-Tan et al.

[11] Patent Number: 4,941,549

[45] Date of Patent: Jul. 17, 1990

[54] FIRE ESCAPE APPARATUS

[76] Inventors: Liou Da-Tan; Chang Shiou-Huey, both of No. 23, Lane 43, Da-Pong Rd., Taichung, Taiwan

[21] Appl. No.: 409,204

[22] Filed: Sep. 19, 1989

[51] Int. Cl.[5] ..... A62B 1/10; A62B 35/00

[52] U.S. Cl. ..... 182/234; 182/235; 182/239; 182/240; 182/42

[58] Field of Search ..... 182/42, 43, 44, 234, 182/235, 240, 239

[56] References Cited

U.S. PATENT DOCUMENTS

| | | | |
|---|---|---|---|
| 184,978 | 12/1876 | Neville | 182/42 |
| 299,511 | 6/1884 | Blessing | 182/42 |
| 637,878 | 11/1889 | LePore | 182/42 |
| 669,656 | 3/1901 | Oslund | 182/42 |
| 708,846 | 9/1902 | Vieregg | 182/42 |
| 715,330 | 12/1902 | Zimmer | 182/42 |
| 4,209,077 | 6/1980 | Yui | 182/42 |
| 4,867,276 | 9/1989 | Tamietti | 182/42 |

*Primary Examiner*—Reinaldo P. Machado
*Attorney, Agent, or Firm*—Browdy and Neimark

[57] ABSTRACT

A fire escaping apparatus being of a small bulk, requiring no energy source and capable of continuously transporting escaping persons is provided. The apparatus includes a housing attached to a place from where relevant persons can escape a fire, a hollow active shaft rotatably mounting therein a following shaft and securing thereon a driving member, an escaping loop rope positively circulating on the periphery of the driving member, a speed-increasing mechansim mounted between the active and following shafts, and a speed-limiting mechanism mounted on the following shaft so that the escaping person grasping on the rope can be rapidly and safely transported from the place to a ground surface.

20 Claims, 14 Drawing Sheets

FIRE ESCAPE APPARATUS

BACKGROUND OF THE INVENTION

The present invention relates to an escape, and more particularly to a fire escaping apparatus.

Due to the usually unconquerable attraction displayed by the city, the building in the city is getting higher and higer in order to accommodate the continuoysly increasing population. It is well-known that a fire often cuts off the power source to disable an elevator and fatally smokes a part of the escaping ladder of the building to cause it to be useless. It is therefore tried by the Applicant to deal with the above situation.

SUMMARY OF THE INVENTION

It is therefore an object of the present invention to provide a fire escaping apparatus being convenient in use, relatively small in size and capable of continuously transporting escaping persons.

According to the present invention, a fire escaping apparatus includes a housing attached to a place from where relevant persons can escape a fire and rotatably mounting therein a hollow active shaft rotatably mounting therein a following shaft, a driving member secured on the active shaft, an escaping loop rope positively circulating on the periphery of the driving member and of being suspended thereunder to be within easy reach of a ground surface for one of the persons, a speed-increasing mechanism mounted between the active and following shafts, and a speed-limiting mechanism mounted on the following shaft so that the one person grasping on the rope can be rapidly and safely transported from the place to the ground surface.

The present invention may best be understood through the following description with reference to the accompanying drawings, in which:

DETAILED DESCRIPTION OF THE PREFERRED EMBODIMENT

Figure 1:
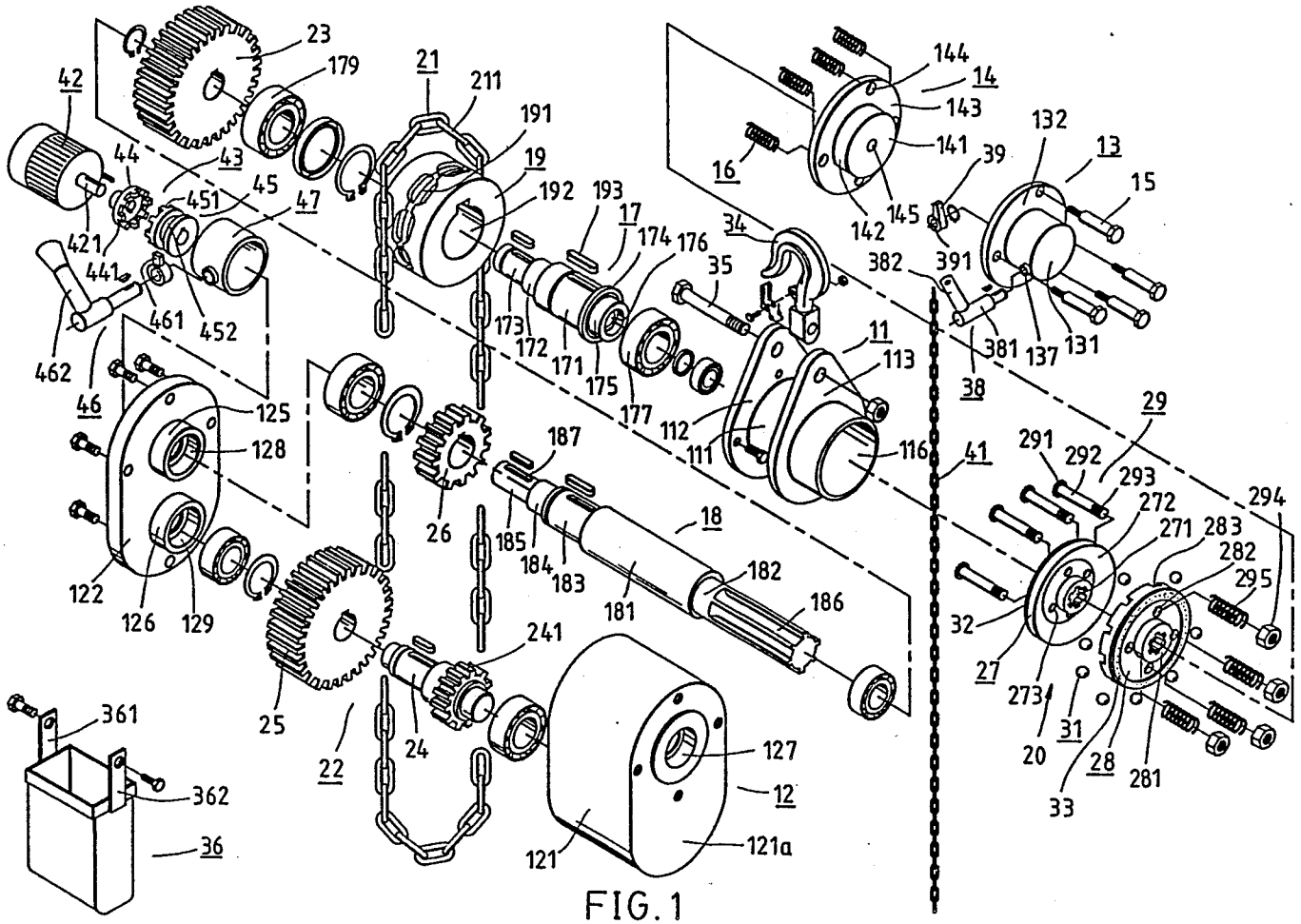
FIG. 1 is an exploded view showing a first preferred embodiment of a fire escaping apparatus according to the present invention.
Figure 2:
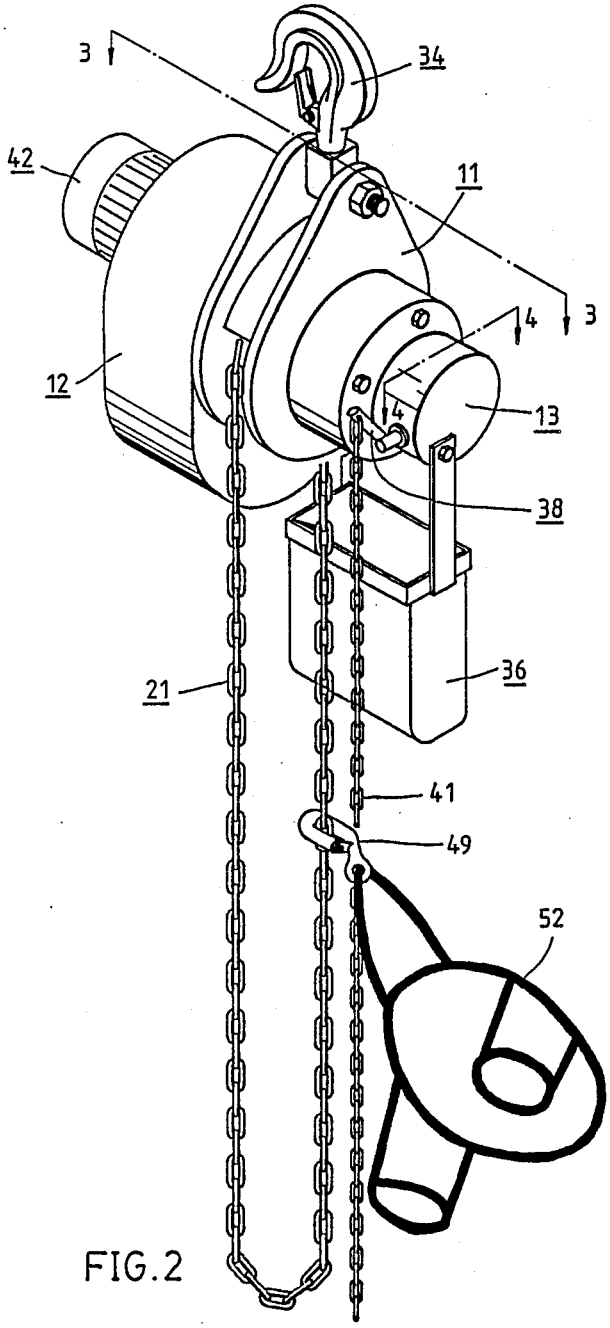
FIG. 2 is a perspective view of a fire escaping apparatus in FIG. 1.
Figure 3:
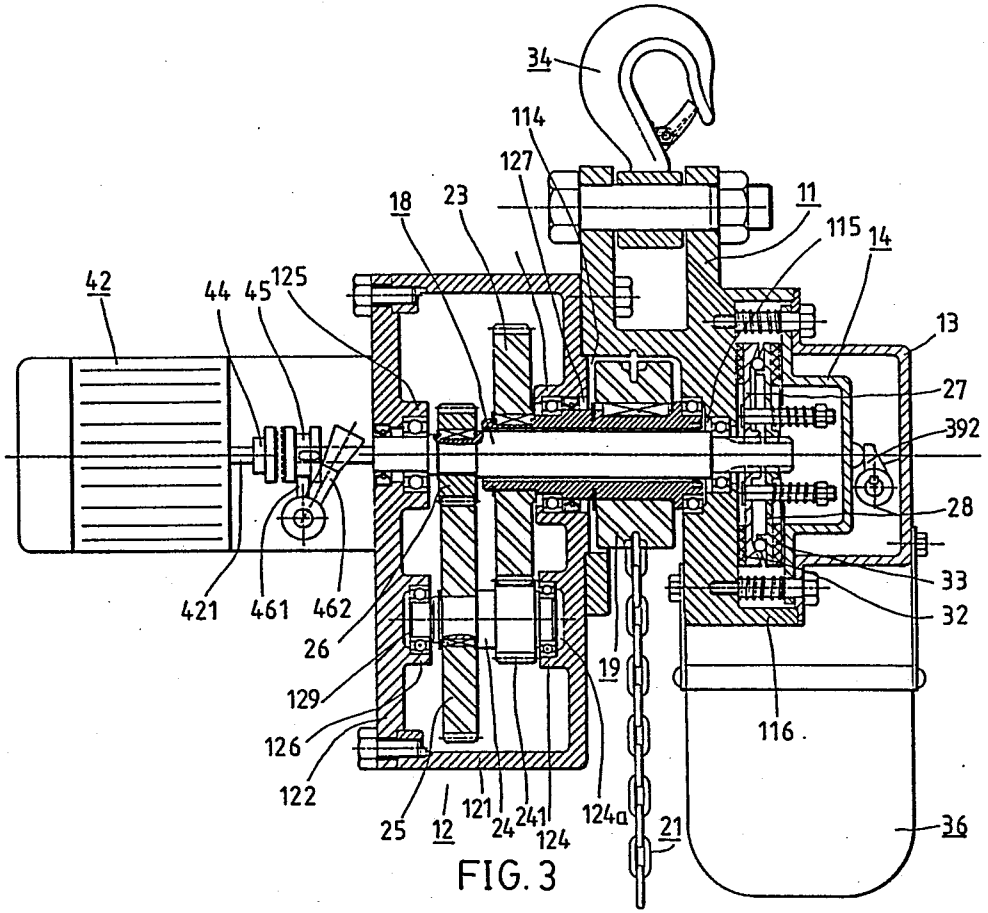
FIG. 3 is a sectional view taken along line 3—3 in FIG. 2.
Figure 4:
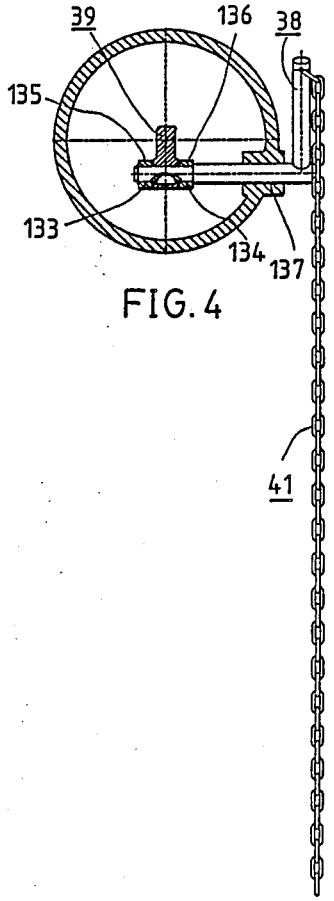
FIG. 4 is a sectional view taken along line 4—4 in FIG. 2.

Referring now to FIGS. 1-10, a first preferred embodiment of the present fire escaping apparatus includes a housing 11, a casing 12, an active shaft 17, a following shaft 18, a driving member 19, an escaping loop rope 21, a speed-increasing mechanism 22, a speed-limiting mechanism 20, a storing case 36, an emergent braking device 37, a switching device 43, and a plurality of carrying devices 48. Housing 11 includes a middle arcuate plate 111 extending at two sides thereof two side plates 112 and 113 respectively having two coaxial through holes 114 and 115, a tubular member 116 integrally extended from side plate 113, and a hooking member 34 pivotally mounted between side plates 112 and 113 by a bolt 35 and a nut.

Casing 12 includes a body 121 and an end plate 122. Body 121 includes a closed plate **121*a* fastened to side plate 112 by 4 bolts and having thereon two sockets 123 and 124 respectively having a through hole 127 and a blind hole 124*a*. End plate 122 is covered on body 121 by 4 bolts and includes thereon two sockets 125 and 126 respectively having a through hole 128 and a blind hole 129**.

Active shaft 17 includes a first shaft portion 171, a second portion 172, a third portion 173, a stopping flange 174, a fourth portion 175 and an axial through hole 176, and is rotatably mounted at one end in through hole 115 of plate 113 by a bearing 177 and at the other end in through hole 127 of plate **121*a* by another bearing 179**.

Following shaft 18 includes a first shaft portion 181, a second portion 182 having thereon a plurality of peripherally axial grooves 186, a third portion 183, a fourth portion 184 and a fifth portion 185 having thereon a plurality of peripherally axial grooves 187, and is rotatably mounted in through hole 176 of shaft 17.

Driving member 19 is a link chain wheel having a peripheral chain groove 191 and a keyway-provided axial through hole 192 and is secured on first portion 171 of active shaft 17 in housing 11 by a key 193. Rope 21 is a link chain formed by a plurality of chain elements 211 and is positively engaged in chain groove 191 for circulating thereon.

Speed-increasing mechanism 22 includes an initial gear 23 keyed on third portion 173 of shaft 17, a geared shaft 24 having two ends thereof respectively rotatably mounted in sockets 124 and 126 of casing body 121 and end plate 122 and including a first gear 241 meshing with initial gear 23 and a second gear 25, and a final gear 26 keyed on third portion 183 of following shaft 18 and meshing with second gear 25.

Speed-limiting mechanism 20 includes an abrasive member 14, a first braking disc 27, a second braking disc 28, centrifugal members 31, fastening media 29, elastic members 295, and two braking linings 32, 33. Abrasive member 14 includes an end plate 141 having a central protuberance 145, an annulus 142 and an end flange 143 having 4 holes 144 respectively passing therethrough 4 bolts 15 respectively sleeving thereon 4 compression springs 16 mounted between side plate 113 and end flange 143. Disc 27 includes a central axial toothed hole 271 slidably but unrotatably engaging therein grooved second portion 182 of following shaft 18, a first braking surface attaching thereto braking lining 32, a second opposite truncated cone-shaped surface 272, and 4 through holes 273. Disc 28 includes a central axial toothed hole 281 slidably but unrotatably engaging therein grooved second portion 182, 4 through holes 282 respectively passing therethrough fastening media 29 respectively passing through through holes 273, a first braking surface attaching thereto braking lining 33, and a second opposite surface forming thereon a plurality of radial grooves 283 cooperating with truncated cone-shaped surface 272 to respectively receive and guide therebetween centrifugal members 31 being balls. Each fastening media 29 includes a head 291, a shank portion 292 sleeving thereon one respective elastic member 295 being a compression spring, and a threaded end 293 screwing thereon a nut 294 cooperating with disc 28 to mount therebetween one respective compression spring 295.

Storing case 36 includes two side arms 361 and 362 for being suspended to any suitable points of the present apparatus.

Emergent braking device 37 includes a cap member 13, an operating piece 38, an engaging piece 39 having an upper engaging surface 392 and a lower hole 391, and an emergent braking rope 41 being a link chain. Cap member 13 includes an end flange 132 matched against tubular member 116 by bolts 15 and urged against end flange 143 of abrasive member 14 by compression springs 16, and a cap body 131 which includes a radial hole 137 and two inner lugs 133 and 134 respectively having two through holes 135 and 136 coaxial with radial hole 137. Operating piece 38 includes a first rod 381 rotatably mounted in holes 135, 136 and 137 and keyedly sleeved in lower hole 391 of engaging piece 39 positioned between lugs 133 and 134, and a second rod 382 fixing thereto braking rope 41.

Switching device 43 includes a secondary housing 47 fixed to end plate 122, a motor 42 mounted on housing 47 and having a motor shaft 421, a first engaging disc 44 secured to shaft 421 and having a plurality of circularly arranged teeth 441, a second engaging disc 45 keyed on fifth portion 185 of following shaft 18 and having circularly arranged teeth 451 and an annular groove 452, and a switching piece 46 having an operating rod 462 and an engaging rod keying thereto an engaging piece 461 engaging in annular groove 452.

Each carrying device 48 includes a connector 49 and a carrying medium 52. Connector 49 includes a body 491 capable of being hooked on rope 21 and having a top threaded hole 493 and a bottom ring 492, and an urging device 494 which includes an urging member 495 having an end hole **495*a* and an opposite arcuate end surface 459*b*, a coil spring 497 having a first end 497*a* inserted in small hole 493*a* adjacent threaded hole 493 and a second end 497*b* resting thereon urging member 495 for urging arcuate surface 459*b* against body 491, and a pivoting bolt 496 which includes a head 496*a*, a pivoting portion 496*b* pivotally received in end hole 495*a*, and a threaded portion 496*c* screwed in threaded hole 493. Carrying medium 52 is formed by nylon rope segments and includes a first loop 521 connected through a connecting segment 522 to bottom ring 492 for looping therein a body portion of an escaping person and two second loops 524 respectively connected at two diametrically opposite sides of first loop 521 by two pairs of side connecting segments 523** for respectively looping therein two legs of the escaping person.

Figure 6:
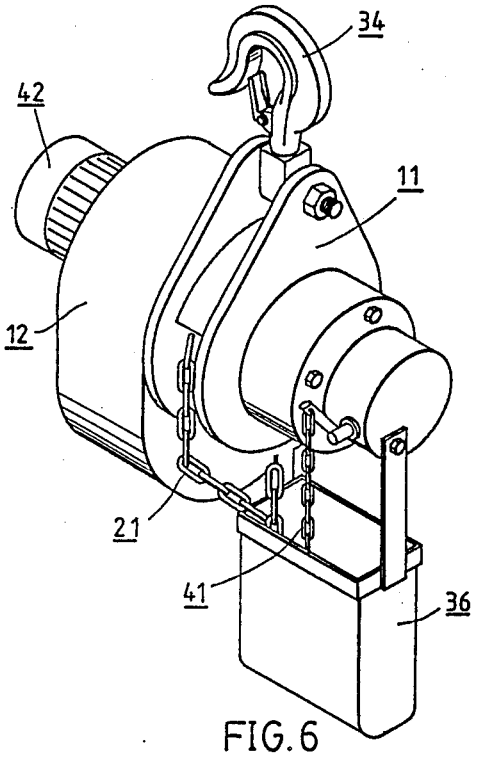
FIG. 6 is a perspective view showing an apparatus in FIG. 1 storing the rope and carrying devices thereof in a storing case.
Figure 5:
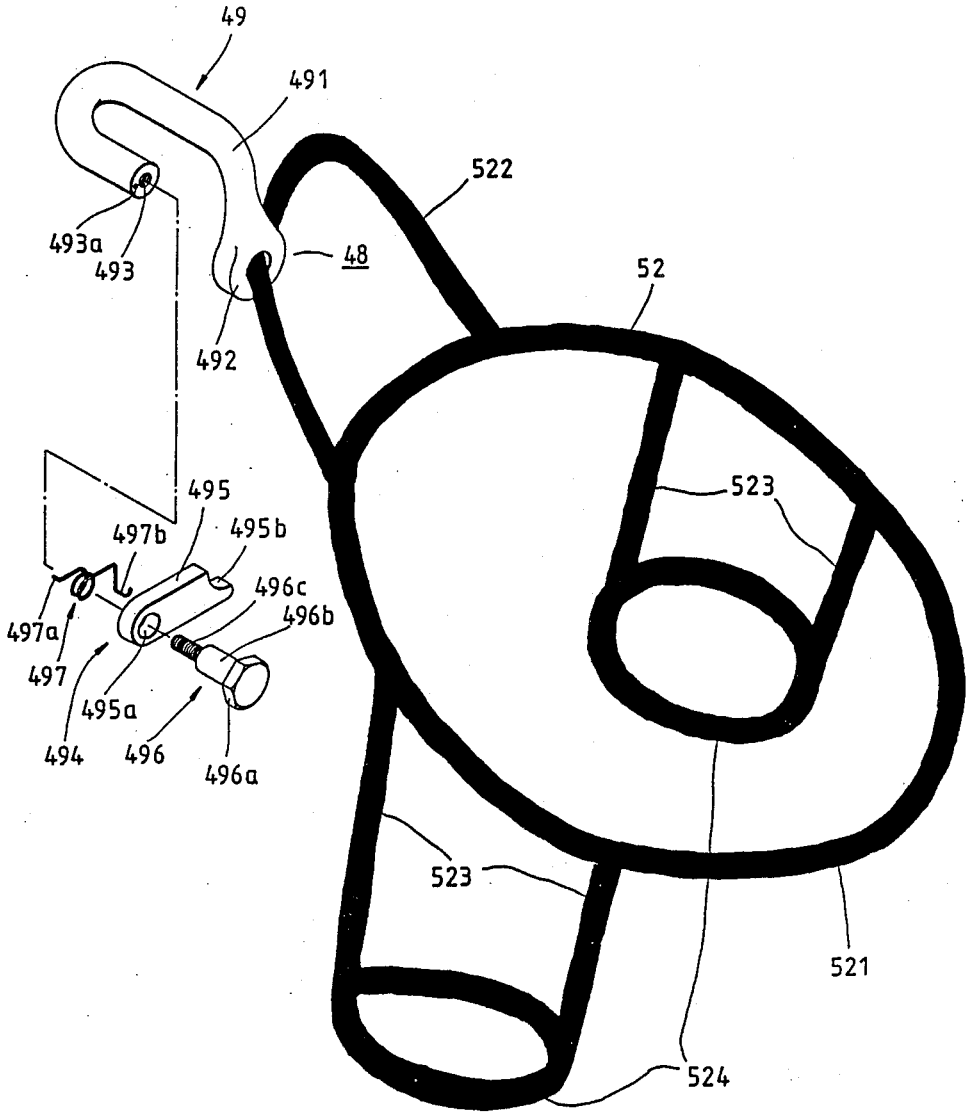
FIG. 5 is an exploded view showing a carrying device of a fire escaping apparatus in FIG. 1.
Figure 7:
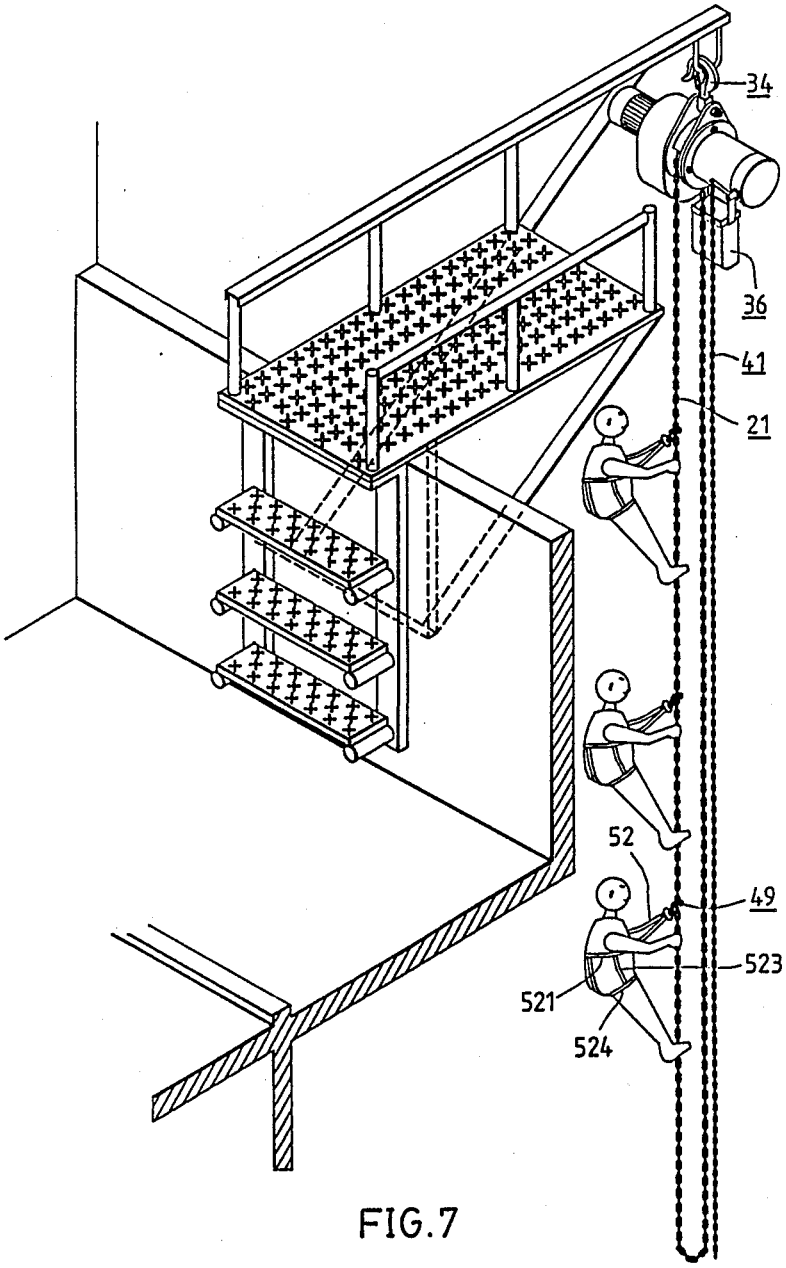
FIG. 7 is a schematic view showing an apparatus in FIG. 1 in operation.
Figure 8:
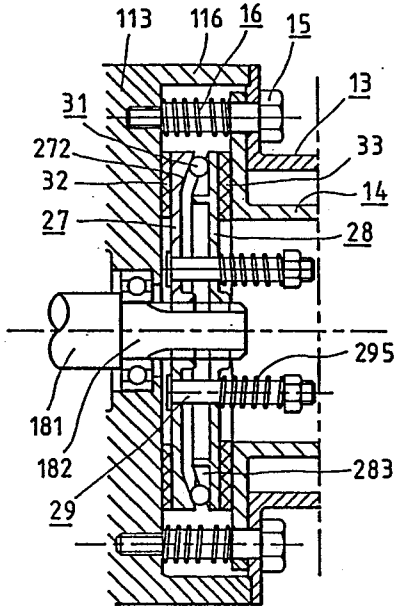
FIG. 8 is a schematically sectional view showing a speed-limiting mechanism of an apparatus in FIG. 1 in a braking state.

FIG. 6 shows that storing case 36 stores therein ropes 21 and 41 and carrying devices 48 if there does not have a fire. If there is a fire, as shown in FIG. 7, hooking member 34 can be hooked to a frame fixed to a short wall of a veranda of the fired building and ropes 21 and 41 are taken out of storing case 36. Then, an escaping person can have himself been carried by a carrying device 48 hooked on a chain element of rope 21 to be transported to a ground surface by his own weight causing driving member 19 and active shaft 17 to rotate which in turn rotates at a higher speed following shaft 18 centrifugally outwardly radially moving, as shown in FIG. 8, balls 31 to produce a force overcoming the spring force provided by compression springs 295 to urge apart braking discs 27 and 28 to in turn respectively abrasively contact braking linings 32 and 33 with side plate 113 and end flange 143 of abrasive member 14 to result in a braking action to slow down following shaft 18 which in turn draws near braking discs 27 and 28 with each other to reduce accordingly the effect of the braking action on following shaft 18 the rotating speed of which is thus increased again, which procedure will be repeated again and again until an equilibrium state is reached which certainly, does not take much time.

Figure 9:
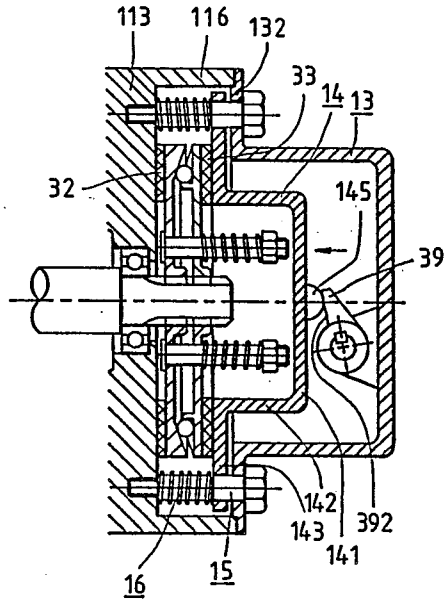
FIG. 9 is a schematically sectional view showing an emergent braking mechanism of an apparatus in FIG. 1 in operation.

If the escaping person finds it necessary to apply an emergent brake for the present apparatus, as shown in FIG. 9, he downwardly pulls rope 41 which engages engaging surface 392 of engaging piece 39 with protuberance 145 to axially translate end flange 143 and braking dises 27 and 28 by overcoming the spring force provided by compression springs 16 in order to stoppingly abrasively contact braking linings 32 and 32 with side plate 113 and end flange 143 respectively to stop rotating following shaft 18 and in turn active shaft 17 and driving member 19.

Figure 10:
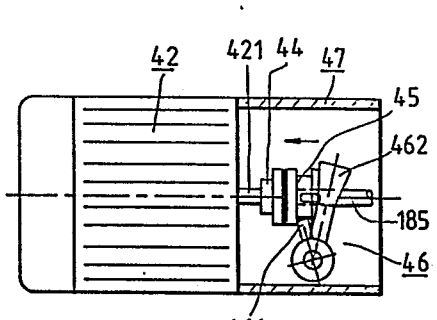
FIG. 10 is a schematic view showing a switching device of an apparatus in FIG. 1 in operation.

FIG. 10 shows that if there is not a fire, the present apparatus can be used as a weight elevator by operating switching piece 46 to mesh together teeth 441 and 451 so that the powered shafts 461 and 18 will rotate, through speed-increasing mechanism 22 acting now as a speed-decreasing mechanism, active shaft 17 and driving member 19 at a lower speed in order to upwardly elevate a weight hooked on rope 21. It should be noticed that the rpm of motor 42 should be set under the critical speed of speed-limiting mechanism 26 in order to free motor 42 from being incapable of rotating at the full speed due to the braking action occurred therewith.

Figure 11:
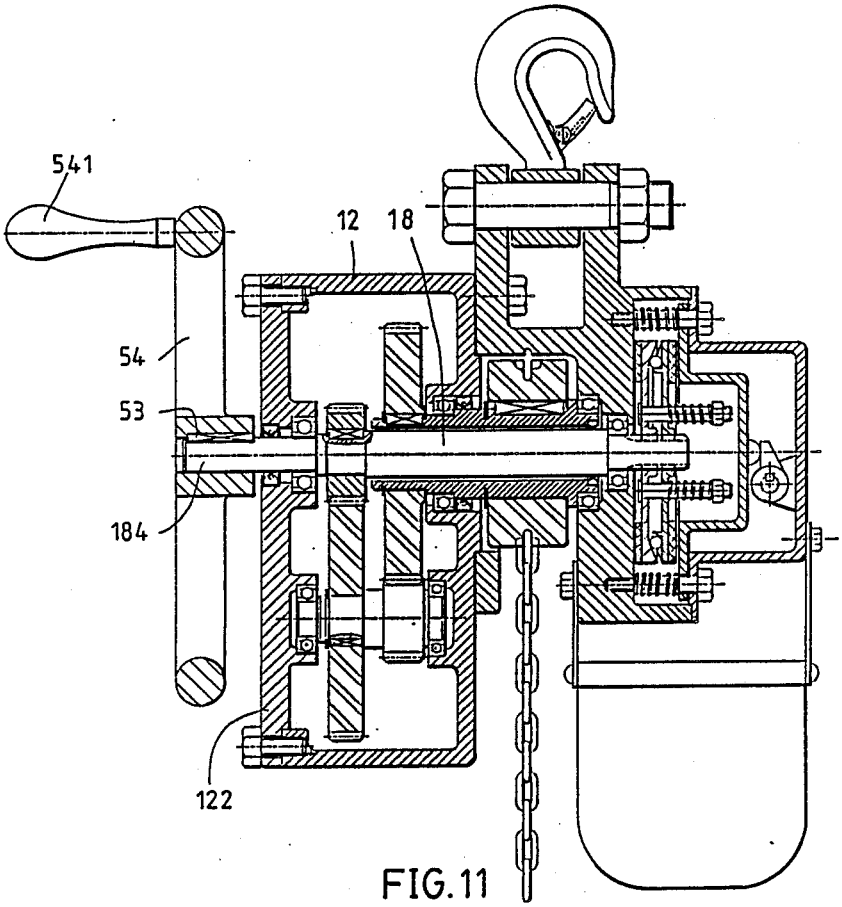
FIG. 11 is a sectional view showing a second preferred embodiment of a fire escaping apparatus according to the present invention.
Figure 12:
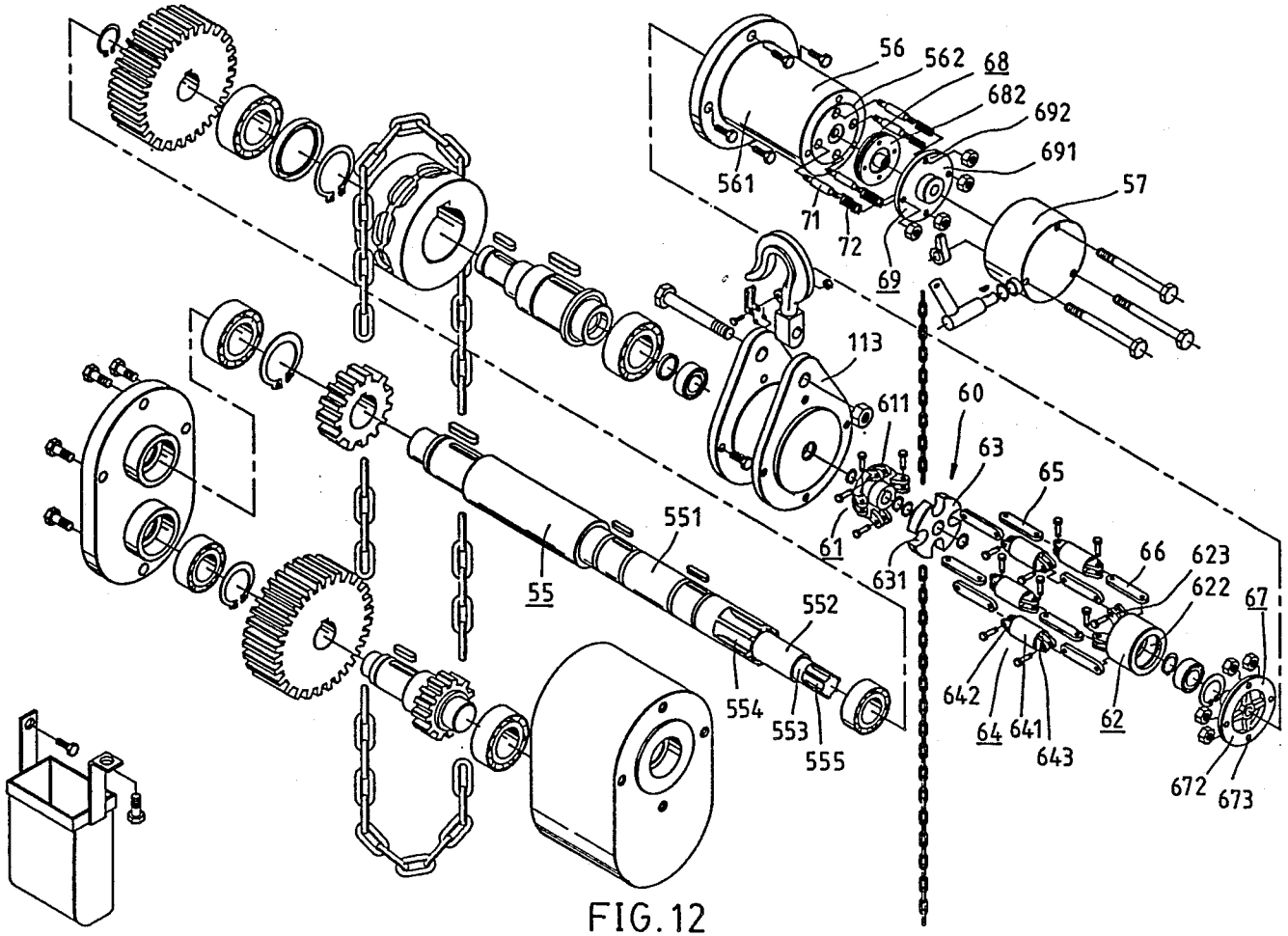
FIG. 12 is an exploded view showing a third preferred embodiment of a fire escaping apparatus according to the present invention.
Figure 13:
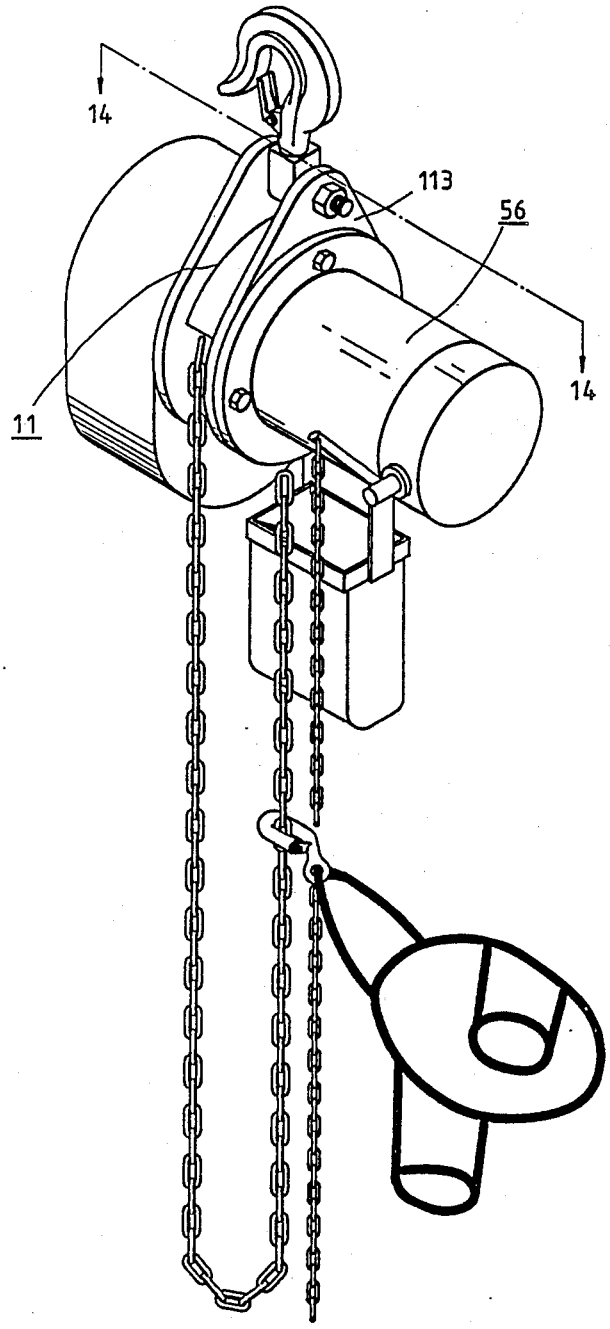
FIG. 13 is a perspective view showing an apparatus in FIG. 12.
Figure 14:
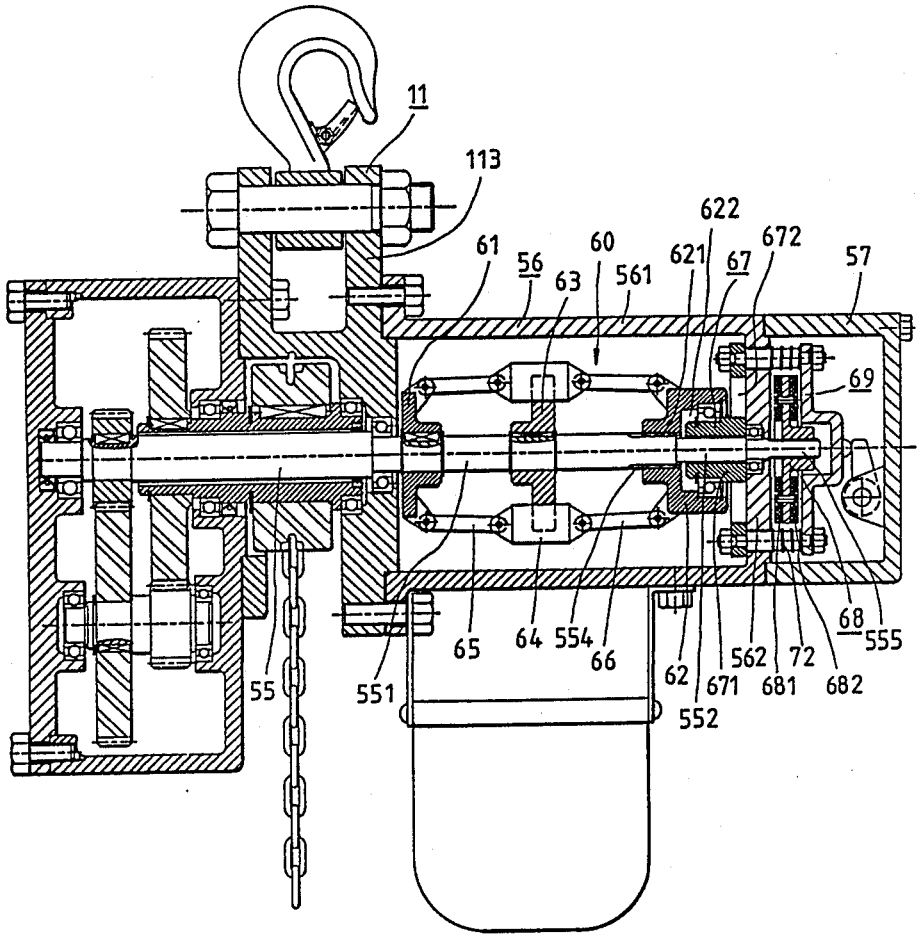
FIG. 14 is a sectional view taken along line 14—14 in FIG. 13.
Figure 15:
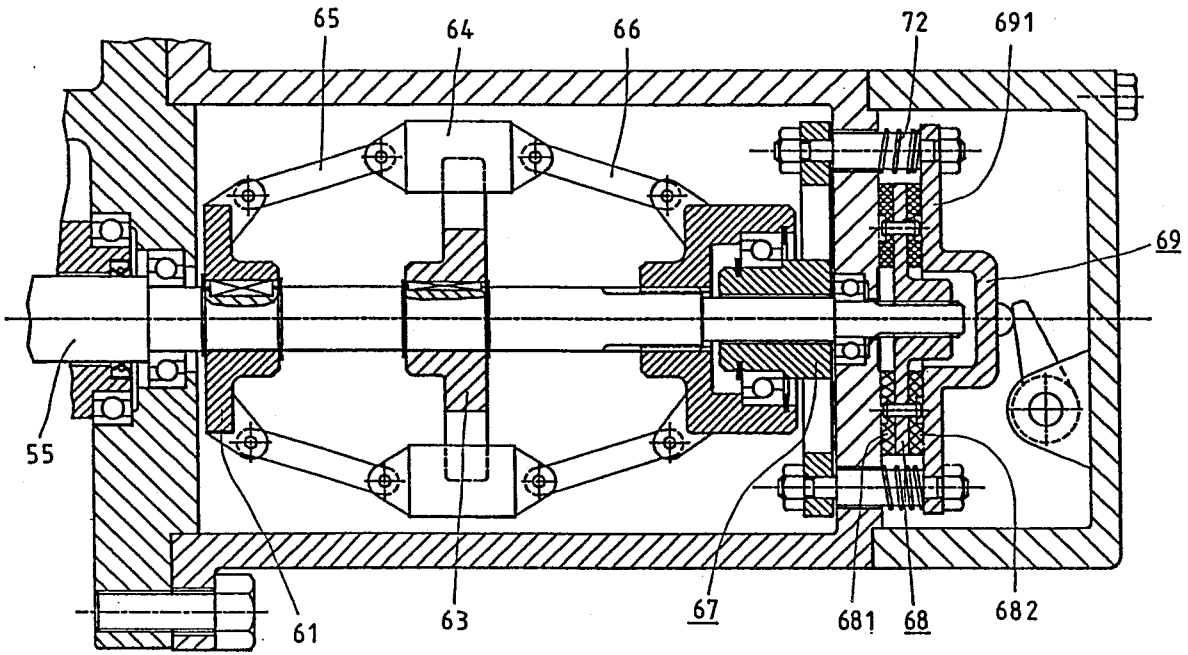
FIG. 15 is a sectional view showing a speed-limiting mechanism of an apparatus in FIG. 12 in a braking state.

FIG. 11 shows a second preferred embodiment of the present apparatus differing from the embodiment shown in FIGS. 1–10 in that following shaft 18 has a lengthened fourth portion 184 keying thereto by a key 53 a handwheel 54 having a handle 541 for rotating following shaft 18 to upwardly elevate a weight. Certainly, in this embodiment, switching device 43 is no longer necessary.

A third preferred embodiment of the present apparatus, as shown in FIGS. 12–15, has a different speed-limiting mechanism from that of the embodiment shown in FIGS. 1–10. The following shaft in this embodiment has a new reference numeral 55 and includes a lengthened second portion 551 having thereon a plurality of peripherally axial grooves 554, a sixth portion 552 and a seventh portion 553 having thereon a plurality of peripherally axial grooves 555. The new speed-limiting mechanism includes a securing base 61 keyed to second portion 551 and having 4 pairs of connectors 611, a sliding base 62 slidably but unrotatably mounted on grooved second portion 551 by means of a first toothed axial hole 621 and having a second axial hole 622 and 4 pairs of connectors 623, a guiding disc 63 mounted on second portion 551 and having 4 peripheral indentations 631, 4 centrifugal members 64 each of which includes a cylindrical body 641 and two opposite pivotal ends 642 and 643, 4 first links 65 respectively pivotally mounted between connectors 611 and connectors 642, 4 second links 66 respectively pivotally mounted between connectors 623 and connectors 643, a tubular member 56 fixed to side plate 113 and having a tubular portion 561 and an end plate 562, a second tubular member 57 fixed to tubular portion 561, an engaging medium 67 having a shaft 671 rotatably but untranslatably mounted in second axial hole 622 of sliding base 62 and an end flange 672 having 4 holes 673, a braking piece 68 rotatably mounted on seventh portion 553 of following shaft 55 and attaching at two opposite side surfaces thereof two braking linings 681 and 682, an abrasive disc 69 being structurally similar to abrasive member 14 in the embodiment shown in FIGS. 1–10 and having an end flange 691 having 4 holes 692, 4 fastening media 71 fastening together engaging medium 67 and abrasive disc 69, and 4 elastic members 72 being compression springs and respectively sleeved on fastening media 71 for usually tending to allow braking linings 681 and 682 not to abrasively contact with end plate 562 and abrasive disc 69 so that when following shaft 55 rotates, centrifugal members 64 respectively guided in peripheral indentations 631 will centrifugally outwardly radially move with respect thereto in order to inwardly axially pull sliding base 62, end flange 672 and abrasive disc 69 to allow braking piece 68 to produce a braking effect for following shaft 55. Certainly, guiding disc 63 can be dispensed with without affecting the function of such speed-limiting mechanism.

Figure 16:
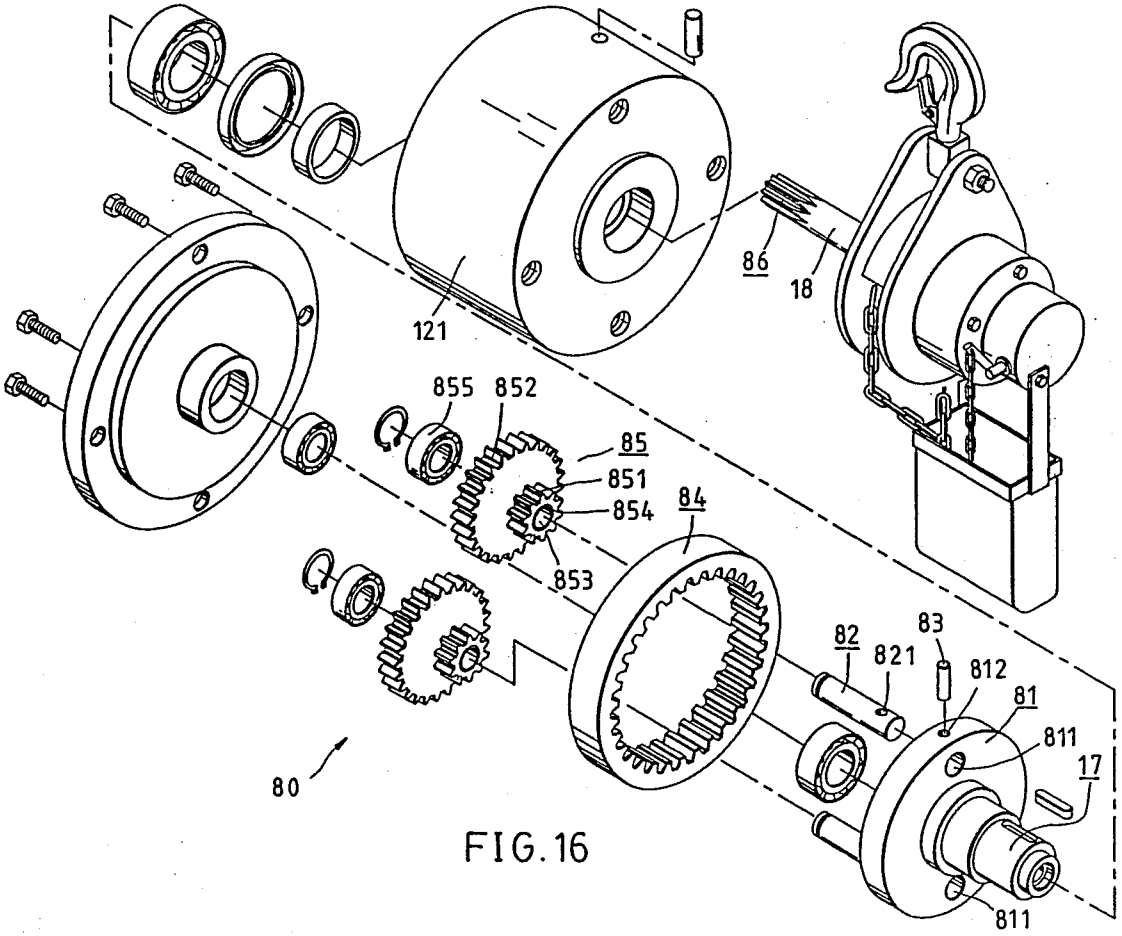
FIG. 16 is a partly exploded view showing a fourth preferred embodiment of a fire escaping apparatus according to the present invention.
Figure 17:
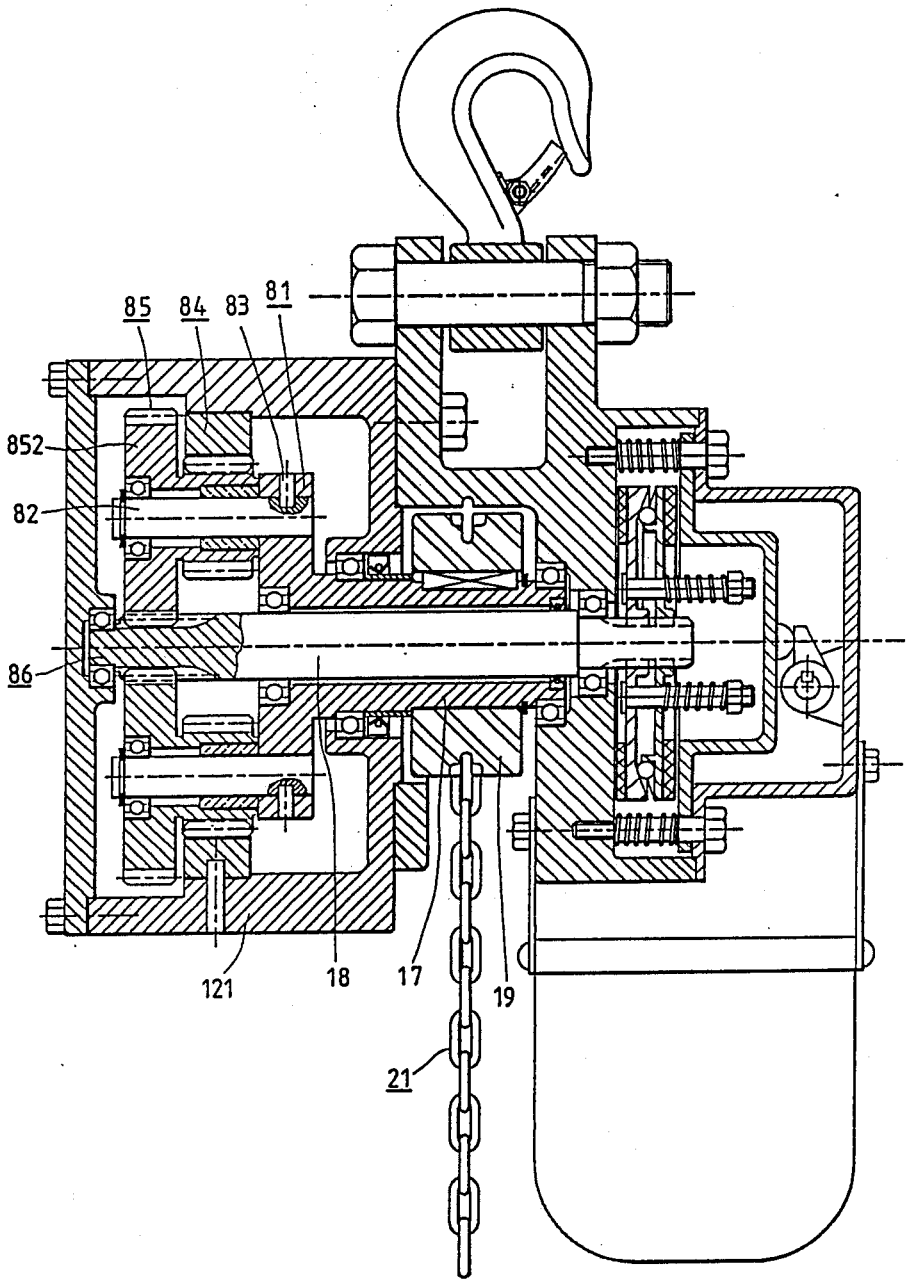
FIG. 17 is a sectional view showing an apparatus in FIG. 16.

A fourth preferred embodiment of the present apparatus, as shown in FIGS. 16 and 17, differs from the embodiment shown in FIGS. 1–10 in that it has a new speed-increasing mechanism 80 being a planet gear train which includes an input end 81 integrally formed to active shaft 17 and having two diametrically opposite axial holes 811 and two radial holes 812 respectively communicating with holes 811, two shafts 82 respectively inserted in holes 811 and having two end blind holes 821 respectively pinning therein two pins 83 respectively pinning through radial holes 812, a ring gear 84 fixedly secured to casing body 121, two duplex planet gears 85 respectively having two axial holes 853 rotatably mounted on shafts 82 by two bearings 854 and 855 respectively and respectively integrally forming thereon diametrally larger gears 852 and smaller gears 851 meshing with ring gear 84, and a sun gear 86 integrally formed to following shaft 18 and meshing with larger gears 852 so that when rope 21 rotates driving member 19, active shaft 17 and input end 81, following shaft 18 is accordingly rotated at a higher speed.

What I claim is:

1. A fire escaping apparatus comprising:

a main housing having a first end, a second opposite end and a through housing hole, and capable of being held attached to a place from where relevant persons can escape a fire;

a hollow active shaft rotatably mounted in said housing hole;

a following shaft rotatably mounted in said active shaft, and having a third end and a fourth opposite end;

a driving member secured on said active shaft and rotatably mounted in said housing hole;

an escaping loop rope capable of positively circulating on a periphery, of said driving member and of being suspended thereunder to be within easy reach of a ground surface for one of said persons;

a speed-increasing mechanism mounted between said active and following shafts for enabling said following shaft to rotate at a speed higher than that of said active shaft; and a speed-limiting mechanism mounted on said fourth end for limiting said speed of said following shaft under a predetermined value so that said one person grasping on said rope can be rapidly safely transported from said place to said ground surface.

2. A fire escaping apparatus according to claim 1, further comprising a plurality of carrying devices each of which is capable of carrying thereon said one person and of being positioned on any segment of said rope.

3. A fire escaping apparatus according to claim 2 wherein said speed-limiting mechanism includes:

a securing base secured on said following shaft;

a sliding base slidably mounted on said following shaft;

a plurality of centrifugal members each of which has a first and a second opposite pivotal ends;

a plurality of first links each of which has two ends respectively pivotally secured on said securing base and said first pivotal end;

a plurality of second links each of which has two ends respectively pivotally fixed to said sliding base and said second opposite pivotal end;

a tubular member fixed to said second end of said housing and having an end plate;

an engaging medium having an end rotatably but untranslatably mounted in said sliding base;

an abrasive disc rotatably mounted on said following shaft;

a braking piece secured on said fourth end and mounted between said end plate and said abrasive disc;

a plurality of fastening media passing through said end plate and fastening together said engaging medium and said abrasive disc; and a plurality of elastic members respectively mounted on said fastening media for usually tending to allow said braking piece not to abrasively contact with said abrasive disc and and said end plate.

4. An apparatus according to claim 3, further comprising a guiding disc mounted on said following shaft and having a plurality of peripheral indentations capable of respectively radially guiding therein said centrifugal members.

5. An apparatus according to claim 2, further comprising a storing case held attached to said housing and capable of storing therein said rope and said carrying devices if there does not have said fire.

6. An apparatus according to claim 2 wherein said speed-increasing mechanism is a planet gear train.

7. An apparatus according to claim 2, further comprising a handwheel held fixed to said third end in order that said apparatus can act as a weight elevator.

8. An apparatus according to claim 2 wherein said speed-increasing mechanism includes:

an initial gear mounted on said active shaft;

a geared shaft rotatably mounted with respect to said housing and having a first gear meshing with said initial gear and a second gear; and a final gear mounted on said following shaft and meshing with said second gear.

9. An apparatus according to claim 8, further comprising a casing fixed to said first end of said housing and rotatably mounting therein said geared shaft.

10. An apparatus according to claim 2, wherein said driving member is a link chain wheel having thereon a peripheral link chain groove and said rope is a link chain.

11. An apparatus according to claim 2, wherein each of said carrying devices includes:

a connector having a first end capable of being fixed to said rope and a second opposite connecting end; and a carrying medium fastened to said second connecting end and being formed by nylon rope segments for suitably and conveniently carrying thereon said one person.

12. An apparatus according to claim 11 wherein said carrying medium includes:

a first loop looping therein a body portion of said one person; and two second loops connected at two diametrically opposite sides of said first loop for respectively looping therein two legs of said one person.

13. An apparatus according to claim 2 wherein said speed-limiting mechanism includes:

an abrasive member limitedly slidably fixed to said second housing end;

a first braking disc slidably but unrotatably mounted on said fourth end and having a first braking surface capable of abrasively contacting with said second housing end and a second opposite truncated cone-shaped surface;

a second braking disc slidably but unrotatably mounted on said fourth end, and having a first braking surface capable of abrasively contacting with said abrasive member and a second opposite surface forming thereon a plurality of radial grooves facing with said truncated cone-shaped surface;

a plurality of centrifugal members respectively received in said radial grooves;

a plurality of fastening media for fastening together said braking discs; and a plurality of elastic members respectively mounted on said fastening media for usually tending to closely urge together said braking discs.

14. An apparatus according to claim 13, further comprising two braking linings respectively attached to said first braking surfaces.

15. An apparatus according to claim 13, further comprising an emergent braking device which includes:

a cap member having a radial hole and limitedly slidably fixed to said second housing end by means of a plurality of fastening media respectively mounting thereon a plurality of elastic members usually tending to fully urge apart said second housing end and said abrasive member;

an operating piece having a first operating end and a second opposite engaging end passing through said radial hole into said cap member;

an engaging piece movably mounted in said cap member and secured to said second engaging end and capable of urging against said abrasive member; and an emergent braking rope fixed to said first operating end.

16. An apparatus according to claim 13, further comprising a switching device which includes:

a secondary housing fixed to said main housing;

a motor mounted on said secondary housing and having a motor shaft;

a first engaging disc fixed to said motor shaft;

a second engaging disc slidably but unrotatably mounted on said third end and capable of being put in a positive contact with said first engaging disc; and a switching piece mounted on said secondary housing and having a first end engaging with said second engaging disc and a second operating end capable of being operated to contact together said engaging discs.

17. An apparatus according to claim 13 further comprising a hooking member fixing thereto said housing for enabling said apparatus to be hooked on said place.

18. An apparatus according to claim 13 wherein said fourth end includes thereon a plurality of peripherally axial grooves.

19. An apparatus according to claim 13 wherein said second housing end integrally extends therefrom a tubular member in which said braking discs are rotatably mounted.

20. An apparatus according to claim 13 wherein said housing includes a middle arcuate plate extending at two sides thereof two side plates respectively forming said first and second housing ends.

* * * * *